US007913463B2

(12) United States Patent
Russell

(10) Patent No.: US 7,913,463 B2
(45) Date of Patent: Mar. 29, 2011

(54) ADJUSTABLE VERTICAL BRACE

(76) Inventor: David Russell, Petoskey, MI (US)

( * ) Notice: Subject to any disclaimer, the term of this patent is extended or adjusted under 35 U.S.C. 154(b) by 365 days.

(21) Appl. No.: 11/895,741

(22) Filed: Aug. 27, 2007

(65) Prior Publication Data

US 2009/0057518 A1 Mar. 5, 2009

(51) Int. Cl.
*E04G 25/08* (2006.01)

(52) U.S. Cl. ..... 52/127.2; 52/146; 52/641; 52/649.2; 52/651.01; 52/651.1

(58) Field of Classification Search ..... 52/127.2, 52/169.1, 150, 745.12, 146, 149, 300, 641, 52/649.2, 650.1, 651.01, 651.1, 655.1, 838, 52/844, 846, 848; 403/353, 188, 384, 405.1, 403/293; 248/222.14, 354.1, 651, 354.6, 248/235; 182/82, 151; 256/64
See application file for complete search history.

(56) References Cited

U.S. PATENT DOCUMENTS

| | | | | |
|---|---|---|---|---|
| 2,774,542 | A * | 12/1956 | Anthony | 238/251 |
| 2,988,181 | A * | 6/1961 | Darrey | 52/646 |
| 3,574,981 | A * | 4/1971 | Henschen | 52/127.2 |
| 3,788,026 | A | 1/1974 | Cook | |
| 3,817,006 | A | 6/1974 | Williams | |
| 3,849,012 | A * | 11/1974 | Krouse | 403/188 |
| 3,874,625 | A | 4/1975 | Hansen et al. | |
| 4,090,364 | A | 5/1978 | Muller | |
| 4,215,784 | A | 8/1980 | Perkins | |
| 4,644,709 | A | 2/1987 | Baumann | |
| 4,872,634 | A | 10/1989 | Gillaspy et al. | |
| 4,979,725 | A | 12/1990 | Hutchings, II et al. | |
| 5,025,937 | A * | 6/1991 | King | 211/192 |
| 5,292,098 | A | 3/1994 | Worthington | |
| 5,524,854 | A | 6/1996 | McSwain et al. | |
| 5,950,760 | A | 9/1999 | Morrison | |
| 5,956,906 | A | 9/1999 | Berich et al. | |
| 6,065,254 | A | 5/2000 | Lanka | |
| 6,212,830 | B1 | 4/2001 | MacKarvich | |
| 6,247,273 | B1 * | 6/2001 | Nickel | 52/127.2 |
| 6,308,467 | B1 | 10/2001 | Timilty | |
| 6,425,712 | B1 | 7/2002 | Vanderklaauw | |
| 6,446,752 | B2 * | 9/2002 | Philippe | 182/82 |
| 6,539,677 | B1 | 4/2003 | Lanka | |
| 6,550,188 | B2 * | 4/2003 | Bolinger et al. | 52/127.2 |
| 6,655,097 | B1 | 12/2003 | Poolaw | |
| 6,655,098 | B2 | 12/2003 | Dillen, II et al. | |
| 6,676,233 | B1 | 1/2004 | Evans et al. | |
| 6,711,871 | B2 | 3/2004 | Beirise et al. | |
| 6,752,570 | B2 | 6/2004 | Lanka | |
| 6,776,383 | B2 | 8/2004 | Lanka | |
| 6,854,222 | B2 | 2/2005 | Hansort | |
| 6,931,805 | B2 | 8/2005 | Gregory et al. | |
| 6,976,339 | B1 | 12/2005 | Riccio et al. | |
| 6,981,573 | B2 | 1/2006 | Nickel | |
| 7,051,838 | B1 | 5/2006 | Torrey | |
| 7,080,417 | B2 | 7/2006 | Jiang | |
| 7,114,296 | B2 | 10/2006 | Klassen et al. | |
| 7,137,227 | B2 | 11/2006 | Franz | |
| 2002/0184850 | A1 * | 12/2002 | Kamenomostski | 52/800.1 |
| 2003/0015633 | A1 | 1/2003 | Pyanowski et al. | |
| 2006/0059856 | A1 | 3/2006 | Gilliland | |
| 2006/0201743 | A1 | 9/2006 | Dell'Erba et al. | |
| 2006/0207215 | A1 | 9/2006 | Bruno | |
| 2006/0260217 | A1 | 11/2006 | Black et al. | |
| 2007/0017742 | A1 | 1/2007 | Latimer et al. | |

* cited by examiner

*Primary Examiner* — Brian E Glessner
*Assistant Examiner* — Patrick Maestri
(74) *Attorney, Agent, or Firm* — Gifford, Krass, Sprinkle, Anderson & Citkowski, P.C.

(57) ABSTRACT

An adjustable bracing system is provided for a vertical wall structure that includes a vertical member having keyed openings and a generally Z-shaped cross-section. The bracing system further includes an extension member and an outrigger bracket that have cleats for removable engagement with the keyed openings of the vertical member and an adjustable strut that is pivotally secured to the bracket member.

14 Claims, 11 Drawing Sheets

10
12
14
16
17
18
20
22
24
40
44
46
48
56
56
58
60
62
122
200
4
4

ADJUSTABLE VERTICAL BRACE

FIELD

The present disclosure relates to bracing structures, and more specifically, to an adjustable static bracing system for a vertical wall structure.

BACKGROUND

Concrete is a popular choice for forming both the interior and exterior walls of a building structure. Concrete walls are generally formed by pouring uncured concrete into a cavity created by wall forms and allowing the concrete to cure. Typically, the concrete wall forms are set up in parallel to define the sides of the concrete wall and interconnected by a series of wall ties that fix the distance between opposing wall forms. One method of forming cast concrete walls is by using discrete wall forms made from insulating and light-weight material, such as for example, an expanded polystyrene (EPS). Such wall forms are generally referred to as insulating concrete (ICF) forms. Benefits of ICF forms include light weight, ease of use, and ability to leave the forms in place after concrete has set and hardened to provide insulation on both the inside and outside of the concrete wall.

Generally, to support the various wall forms as they are set in place and to resist movement caused by typical construction loads, including hydrostatic pressure generated during the pouring process and wind forces, support braces are conventionally used to shore the wall forms and retain the forms in place until the cast concrete wall has properly cured. Many of such support braces are difficult to transport between construction sites; have limited capability for adjustment once assembled in place; and have inherent height restrictions.

SUMMARY

In accordance with the present invention, an adjustable bracing apparatus for vertical wall structures that offers improved versatility is provided. In one aspect, the present disclosure provides a bracing system for supporting a vertical structure that includes a vertical member comprising at least two keyed openings, the vertical member having a substantially Z-shaped cross-section; a bracket comprising at least two cleat members being removably engagable with the at least two keyed openings of the vertical member; and an adjustable strut member having an end secured to the bracket.

In another aspect, the present disclosure provides a brace assembly for a vertical tall wall structure that includes a first vertical member and a second vertical member, each of the first and second vertical members respectively having a first end and a second end defining therebetween a longitudinal axis and at least two openings disposed along each of said respective longitudinal axes, wherein the first and second vertical members are arranged along their respective longitudinal axes so that a second end of the first vertical member is connected to a first end of the second vertical member; and an extension member comprising a plurality of engagement members, wherein one of the plurality of engagement members is slidably engaged with a first opening of the first vertical member at the second end and another of the plurality of engagement members is slidably engaged with a second opening disposed on the second vertical member at the first end, wherein when the plurality of engagement members are secured in the first and second openings, respectively, the first and second vertical members are securely coupled together for supporting the tall wall structure.

In yet another aspect, the present disclosure provides a brace assembly for a vertical tall wall structure that includes a vertical member defining a longitudinal axis, the vertical member having a plurality of keyed openings formed therein and comprising a plurality of discrete vertical sections and an extension member securing the discrete vertical sections, wherein the extension member comprises a plurality of cleat members, wherein at least one of the plurality of cleat members is secured within a corresponding one of the plurality of keyed openings associated with each of the discrete vertical sections; a bracket having a first lateral end and a second lateral end, wherein the first lateral end is secured to the vertical member via at least two of the plurality of keyed openings and the second lateral end includes at least one second opening; and an adjustable length strut member having a distal end and a proximal end, wherein the proximal end is secured to the second lateral end of the bracket member via the second opening and the distal end is pivotally coupled to a support substantially orthogonal to the longitudinal axis.

In still another aspect, the present disclosure provides an apparatus comprising a wall structure including a lower end; a foundation located adjacent the lower end of said wall structure; a pin removably secured to the foundation; an elongated body including a first end and a second end, the first end being pivotally attached to the wall structure; and a foot assembly movably coupled to the second end, the pivot foot assembly including a foot bracket having an opening, wherein the opening operably receives the pin and the foot assembly is operably secured to the foundation by the pin member extending through the opening.

In still another aspect, the present disclosure provides a method of assembling a bracing structure for a building wall structure, the method comprising attaching a vertical member to the building wall structure, wherein the vertical member has a substantially Z-shaped cross-section and includes at least two keyed openings; securing a bracket to the vertical member via the at least two keyed openings; and attaching an adjustable strut member to the bracket.

Further areas of applicability will become apparent from the description provided herein. It should be understood that the description and specific examples are intended for purposes of illustration only and are not intended to limit the scope of the present disclosure.

DETAILED DESCRIPTION

Figure 1:
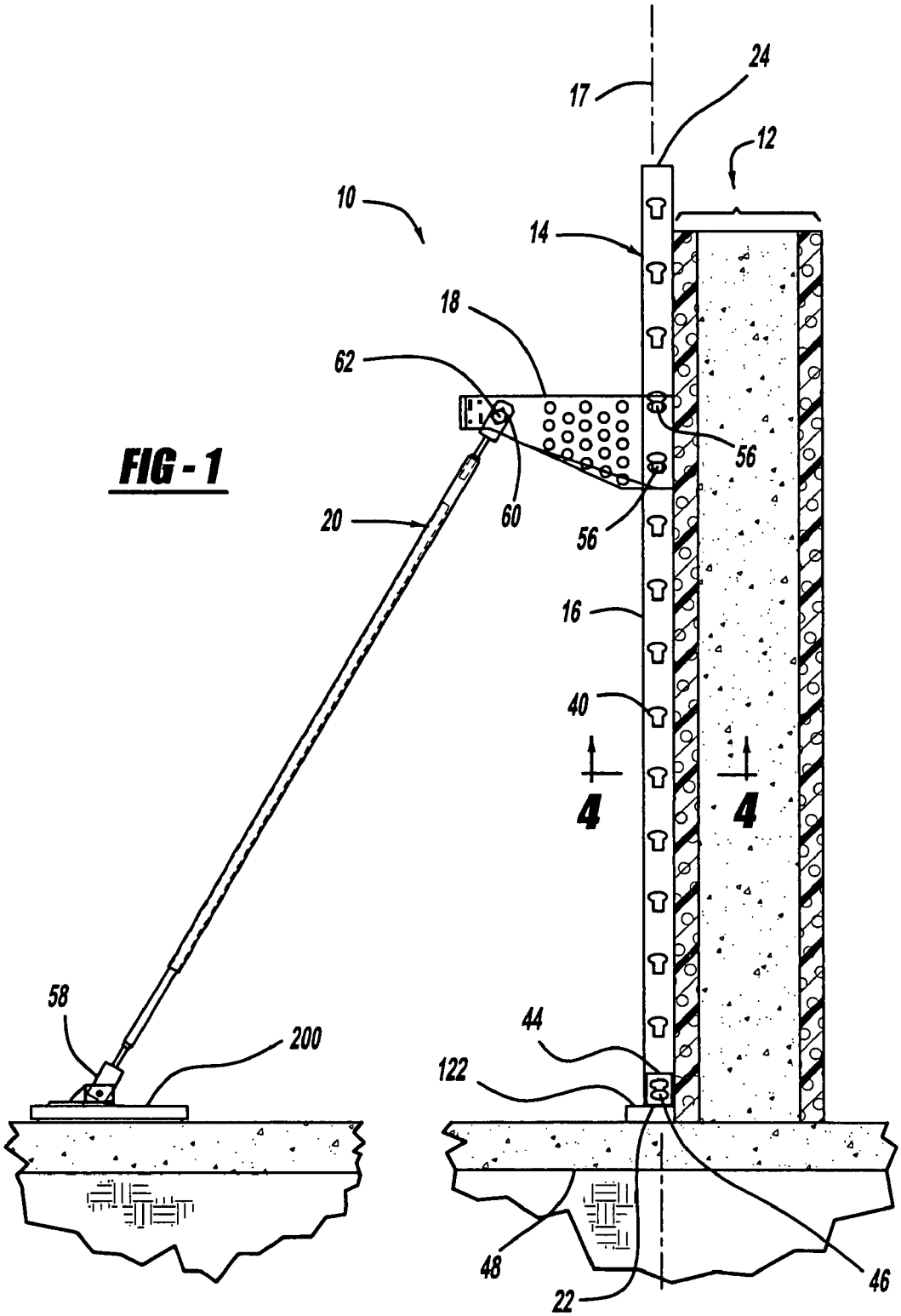
FIG. 1 is a partially fragmented side elevational view of an adjustable bracing system for a vertical wall structure according to the principles of the present disclosure.

The following description is merely exemplary in nature and is not intended to limit the present disclosure, application, or uses. It should be understood that throughout the drawings, corresponding reference numerals indicate like or corresponding parts and features.

In conventional wall bracing systems, after concrete has been poured into a form and the concrete has fully cured, the wall forms are often stripped from the walls and reused. Many conventional concrete forms are made of wood and steel. These forms can be very large and heavy and therefore, require sturdy structural braces to adequately hold them in position until the concrete has adequately set. ICF forms, on the other hand, tend to be relatively lightweight and durable and can include, by way of example, two polymer-based (e.g., EPS) panels held together by plastic ties and defining a form therebetween. ICF forms typically include fastening surfaces or anchoring regions, often associated with the plastic ties, which allow support structures to be attached to the outside of the ICF forms to provide support thereto.

Various conventional support braces are commonly fastened to wall forms and supported by a leg secured to a suitable surrounding horizontal base or foundation. Often, when building a concrete wall, there is a need to adjust the position of the wall forms and/or corresponding wall structure during the construction process. However, adjustable braces have not provided the capability to make adequate fine adjustments to the position of the wall forms and corresponding wall structure once positioned in a weight-bearing assembly. Furthermore, conventional wall braces do not adequately provide support to so-called "tall wall" structures, for example, those walls having heights above about 10 to 12 feet. Once the concrete cures, the support braces are disassembled and removed from the wall forms. Many reusable support braces tend to be cumbersome and heavy, when transported from one job site to another. In accordance with the various embodiments of the present disclosure, a brace assembly system is provided that is relatively lightweight, strong, durable, easy to use and transport, and provides the ability for frequent adjustment, fine tuning and shoring of a wall system, even after assembly into a weight-bearing position, and high wall structure support.

Referring to FIG. 1, a first preferred embodiment of an adjustable brace assembly 10 for a vertical wall structure 12 according to the principles of the present disclosure will now be described. Wall structure 12 can be a poured concrete wall formed using ICF forms. Alternatively, wall structure 12 can be any other vertical wall structure, which requires brace assemblies for support, such as masonry and conventional poured cement forms. However, the principles of the present disclosure are particularly advantageous for use in conjunction with ICFs, as will be described in further detail herein. For exemplary purposes, brace assembly 10 will be described herein with reference to ICF forms associated with wall structure 12.

With particular reference to FIGS. 1-4, brace assembly 10 engages wall structure 12 and is configured to provide adjustable lateral support for wall structure 12. Brace assembly 10 includes a frame assembly 14 having a vertical member 16, an outrigger bracket 18, and an adjustable strut 20. Frame assembly 14 includes vertical member 16 having a first end 22 and a second end 24. Vertical member 16 has a longitudinal axis designated 17. Vertical member 16 has a length 26 between the first end 22 and second end 24 which is substantially greater than its width. In certain preferred aspects, the length 26 of the vertical member 16 is optionally about 8 feet to about 10 feet long, however, any variety of lengths that are suitable in accordance with conventional construction standards for wall structures 12 are contemplated.

Figure 4:
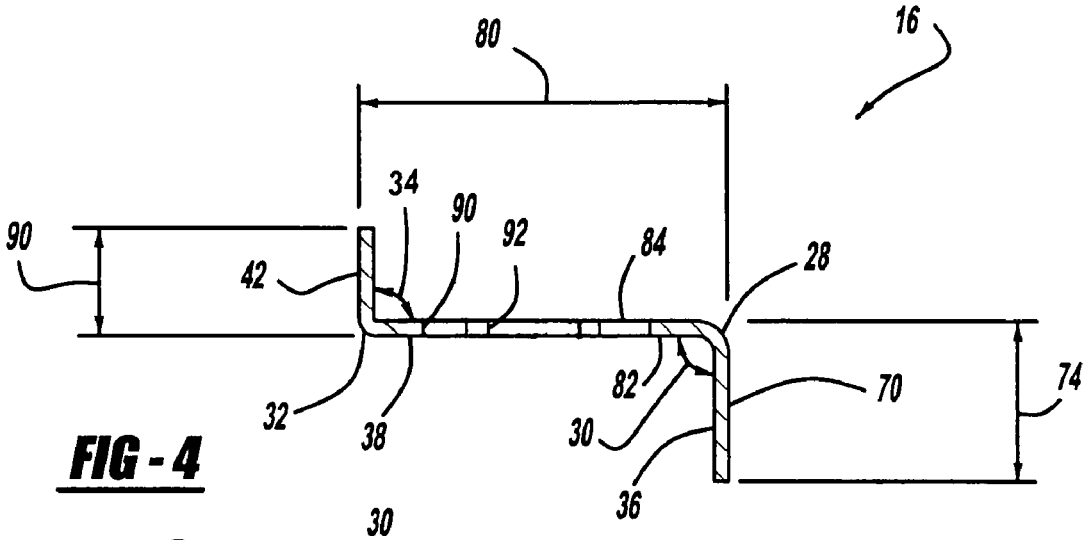
FIG. 4 is a cross-sectional view of the vertical member associated with the adjustable bracing system shown in FIG. 1.

As will be described in further detail below, vertical member 16 has a cross-section (best seen in FIG. 4), which has at least two bends formed therein, optionally more than two bends. By way of illustration, a "bend" is meant to indicate that an otherwise undisturbed plane corresponding to the vertical member 16 cross-section has at least two distinct angles formed therein, typically by a metal-working deformation process, such as stamping. In certain embodiments, the plurality of bends define a first bend 28 having a first angle 30 and a second bend 32 having a second angle 34. The first angle 30 and the second angle 34 may be the same or different from one another. Preferably, the first and second bends 28, 32 are transverse to one another. In certain embodiments, the first angle 30 and/or second angle 34 is greater than or equal to about 85°. In certain aspects, the cross-section with a plurality of bends defines a sinusoidal geometry. In certain embodiments, the first angle 30 and/or second angle 34 is greater than or equal to about 90°. In certain preferred embodiments, the first angle 30 and the second angle 34 are equal to about 90°, such as is shown in FIG. 4. In this embodiment, the plurality of bends defines a first bend having a first angle 30 and a second bend having a second angle 34, wherein the angle is about 90°. In this embodiment, the plurality of bends defines a substantially "Z-shaped" geometry.

Thus, the at least two bends 28, 32 in the cross-section of vertical member 16 create a first flange portion 36, a web portion 38 having a plurality of openings 40 for receiving engagement members, and a second flange portion 42. The first end 22 of vertical member 16 includes an end plate 44 having a cleat 46. Vertical member 16 can be fastened to wall structure 12 as shown.

Frame assembly 14 is pivotally connected to a base 48 defining a plane that is that is substantially orthogonal to the longitudinal axis 17 of vertical member 16. As shown in FIG. 1, base 48 is a foundation that is substantially orthogonal to both the wall structure 12 and to the longitudinal axis 17.

Thus, vertical member 16 is fastened at the first end 22 to foundation base 48 and extends in a vertical direction along longitudinal axis 17 that is generally parallel to wall structure 12. Foundation base 48 provides ground support for wall structure 12 and can be a poured concrete slab-on-grade foundation as shown. Alternatively, foundation base 48 can be a spread footing as is commonly used for construction of wall structures or any other suitable foundation for supporting wall structure 12. Other suitable foundation bases 48 include graded earth and the like.

Outrigger bracket 18 has a first lateral end 50 and a second lateral end 52. A pair of engagement members 56, such as cleats, is disposed on the first lateral end 50. As will be described in more detail below, any variety of readily detachable engagement members compatible with slot-type openings well known in the art are suitable for use in conjunction with various embodiments described herein, including integral engagement members, such as pegs, cleats, or the like. A preferred embodiment of the present disclosure provides the engagement members of outrigger bracket 18 as cleats 56.

The brace assembly 10 further includes strut 20 having a distal end 58 and a proximal end 60. The strut 20 has an engagement member 62 at the proximal end 60, where a preferred embodiment is a similar cleat-type engagement member 62. The cleat engagement member 62 of strut 20 engages with at least one second opening 64 on second lateral end 52 of outrigger bracket 18.

When the brace assembly 10 is assembled and in a weight-bearing position for supporting the wall structure 12, the first lateral end 50 of outrigger bracket 18 is coupled to the vertical member 16 via cleats 56 through openings 40 and is substantially orthogonal to longitudinal axis 17 and substantially parallel to the plane defined by foundation base 48. The second lateral end 52 of outrigger bracket 18 is removably and pivotally secured to the proximal end 60 of strut 20. The vertical frame assembly 14 (including vertical member 16), strut 20, and outrigger bracket 18 are coupled to one another in a weight-bearing relationship to provide structural support to the wall structure 12.

With renewed reference to vertical member 16 in FIG. 4, the brace assembly of the present disclosure provides a lightweight and robust system. As described above, the vertical member 16 has a cross-section with at least two bends formed therein. Thus, vertical member 16 includes a first contact surface 70 adjacent to a substantially orthogonal second contact surface 72, where the first contact surface 70 contacts at least a portion of the wall structure 12 and the second contact surface 72 contacts at least a portion of the outrigger bracket 18.

First flange portion 36 is generally planar in shape and engages wall structure 12 along the first contact surface 70 that is generally parallel to wall structure 12. First contact surface 70 is defined by a width 74 that provides sufficient area to allow loads to be transferred between the ICF forms associated with wall structure 12 and brace assembly 10. For example, in certain preferred embodiments, a suitable dimension for width 74 is about 0.5 to about 3 inches, optionally about 1 to about 2 inches, and in certain aspects, preferably about 1.5 inches. First flange portion 36 can include a plurality of slots 76, 78 (see FIG. 3) extending through first flange portion 36 along an axis parallel to longitudinal axis 17 that allows vertical member 16 to be attached to wall structure 12 by a plurality of fasteners (not shown). Slots 76, 78 can be oriented in a generally horizontal and vertical fashion, respectively, as shown. For exemplary purposes, slots 76, 78 can be positioned at regular intervals along first flange portion 36 corresponding to dimensions of attachment regions associated with the ICF forms of wall structure 12. For example, such slots can be arranged at 6 inch intervals to correspond to an anchoring region of an ICF. Slots 76, 78 can be arranged in a generally alternating fashion as shown to provide a visual cue for determining the specific points at which vertical member 16 is to be fastened to wall structure 12. For example, if vertical member 16 is to be fastened to wall structure 12 every foot (12 inches), vertical member 16 can be fastened to wall structure 12 using only horizontal slots 76 or vertical slots 78 where slots 76, 78 are alternatively spaced at 6 inch intervals as previously described. Similarly, a plurality of slots 76 or slots 78 can be positioned adjacent one another to provide a visual cue that vertical member 16 is to be secured to wall structure 12 at several successive attachment points.

Vertical member 16 can be formed of a wrought or stamped metal, such as galvanized stainless steel or aluminum. Alternatively, vertical member 16 can be an extruded part. As described above, the cross-section of vertical member 16 preferably defines at least two bends having a first angle 30 and a second angle 34. For example, in certain embodiments, the vertical member 16 is formed of an 11-gage galvanized steel sheet metal, which is stamped to have the desired cross-sectional conformation. In certain preferred embodiments, the vertical member is formed from a stamped 12-gage galvanized steel sheet metal. Thus, vertical member 16 optionally has a generally Z-shaped cross-section as best seen in FIG. 4. In this manner, in accordance with the present disclosure, the cross-sectional geometry of the vertical member 16 exhibits good strength and robustness, while still being lightweight. In addition to structural benefits, including enhanced weight-load distribution, the at least two bends in the cross-section provide for a higher stacking density that is beneficial when transporting vertical member 16, thus maximizing packing density and minimizing volume occupied during transport.

Figure 2:
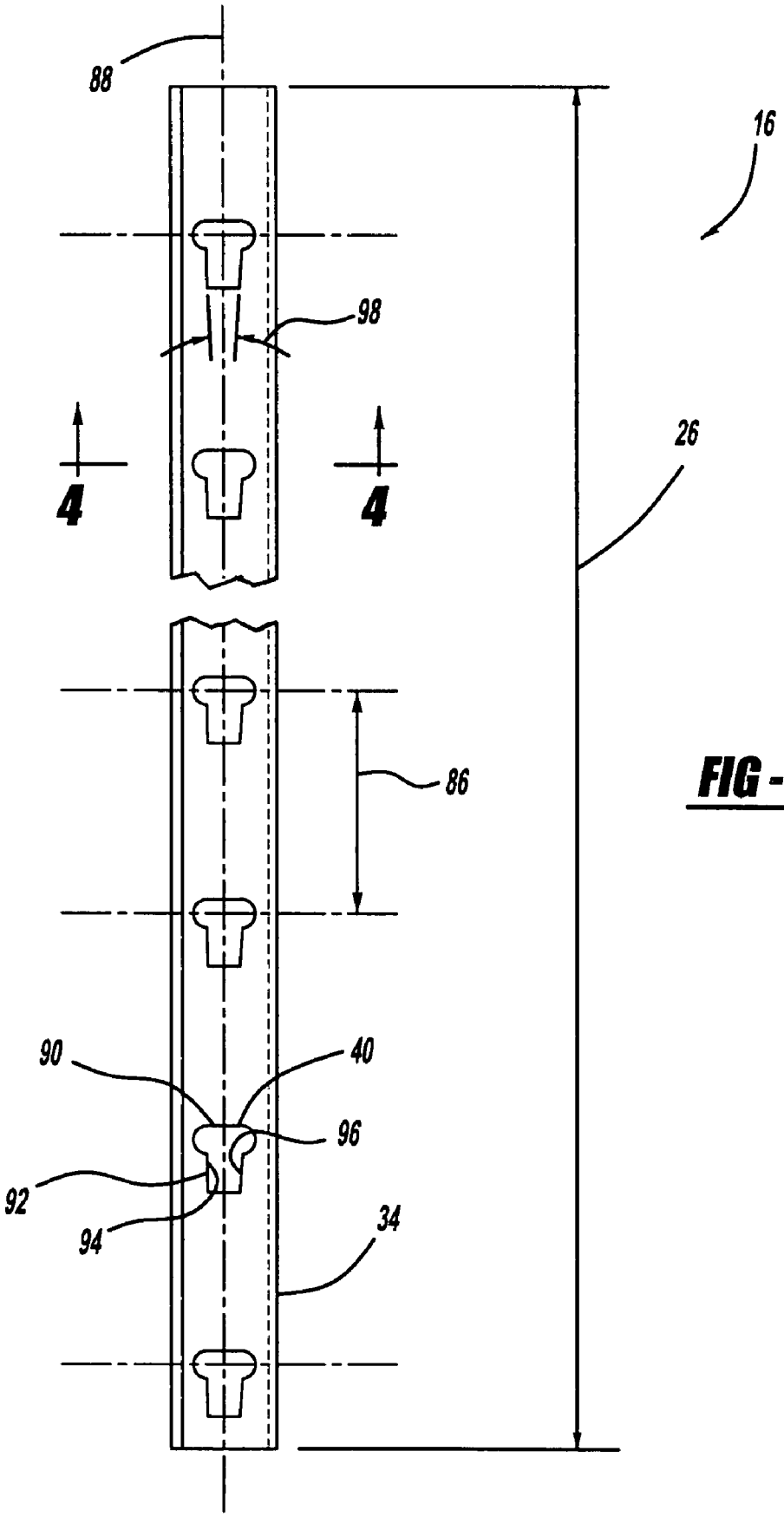
FIG. 2 is a partially fragmented side elevational view of the vertical member associated with the adjustable bracing system shown in FIG. 1.
Figure 3:
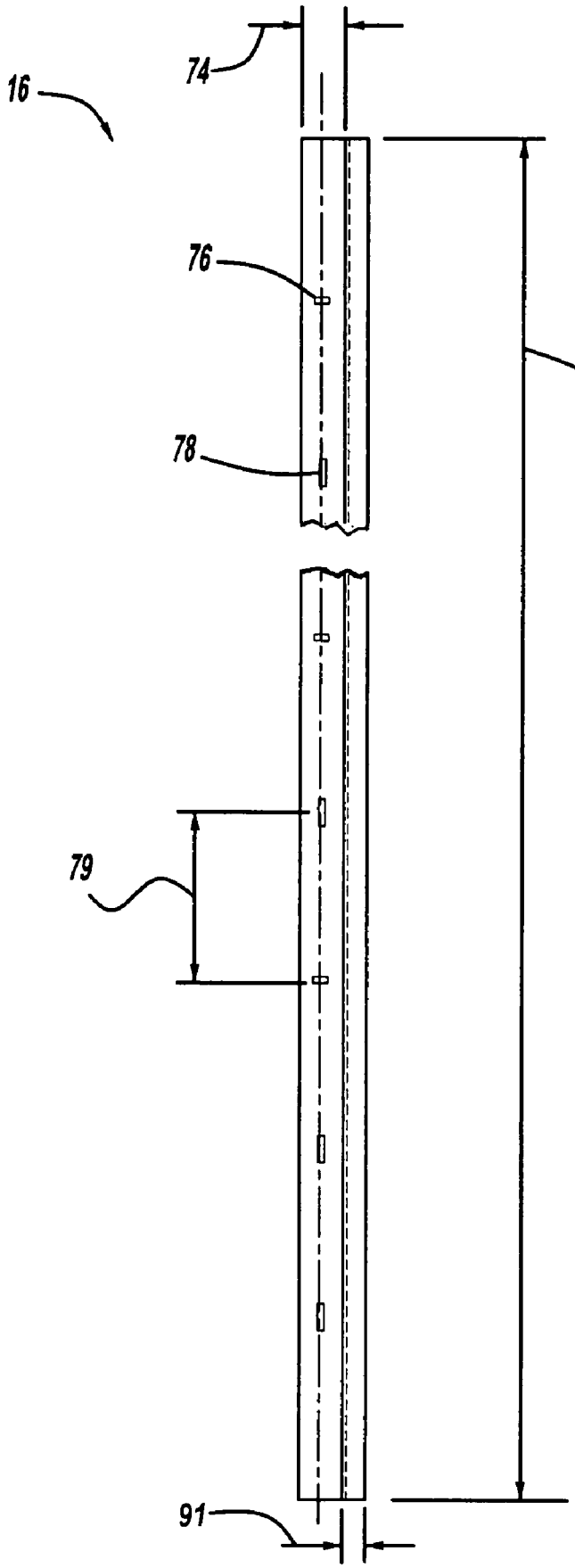
FIG. 3 is a partially fragmented front elevational view of the vertical member associated with the adjustable bracing system shown in FIG. 1.

Thus, web portion 38 of vertical member 16 adjoins first flange portion 36 and is configured to receive and transmit loads between wall structure 12 and outrigger bracket 18. To this end, web portion 38 has a width 80 sufficient to accommodate openings 40, yet prevent buckling of vertical member 16 under typical loads. While a variety of dimensions are contemplated, as recognized by those of skill in the art, a preferred dimension for width 80 is about 3 to about 4 inches, for example, a preferred dimension for width 80 in a 12-gage steel thickness is about 3.75 inches. Web portion 38 has a first face 82 facing first flange portion 36 and a second face 84 facing second flange portion 42. A plurality of slot-like openings 40 extend through web portion 38 and are aligned along longitudinal axis 17 at a regular interval 86 as best seen in FIG. 2. For exemplary purposes, interval 86 is about 8 inches. While a variety of openings are contemplated for removable detachment with cleats 46, 56, a preferred embodiment has so-called "key" shaped openings 40. Keyed openings 40 have a major axis 88 substantially parallel to the longitudinal axis 17 and have an upper portion 90 configured to receive cleats 46, 56 and a lower portion 92 having bearing walls 94, 96 configured to slidably engage and support cleats 46, 56. Upper portion 90 can be generally oval in shape as shown and is sized to allow cleats 46, 56 to pass into upper portion 90. Lower portion 92 can be generally u-shaped, where walls 94, 96 form tapered sides of lower portion 92 that snugly engage a portion of cleats 46, 56 as cleats 46, 56 are slid within lower portion 92 to provide an interference fit. Thus, walls 94, 96 can define an acute included angle 98. In certain preferred embodiments, included angle 98 can be between 3° and 4° to provide a self-locking feature to lower portion 92 of keyed openings 40. For exemplary purposes, included angle 98 is about 3.5°. In this manner, keyed openings 40 can work together with cleats 46, 56 to allow outrigger bracket 18 and end plate 44 to be removably secured to vertical member 16 at various points along the length of vertical member 16.

Second flange portion 42 adjoins web portion 38 opposite first flange portion 36. Second flange portion 42 provides additional lateral support to web portion 38 and helps to prevent damage to web portion 38 during the transportation, assembly, and use of vertical member 16. Additionally, second flange portion 42 can be used to fasten a whaler (not shown) to vertical member 16 to provide additional support along the length of wall structure 12 as may be desired. A width 91 of second flange portion 42 equal to 1 inch has been found to be suitable.

Figure 5:
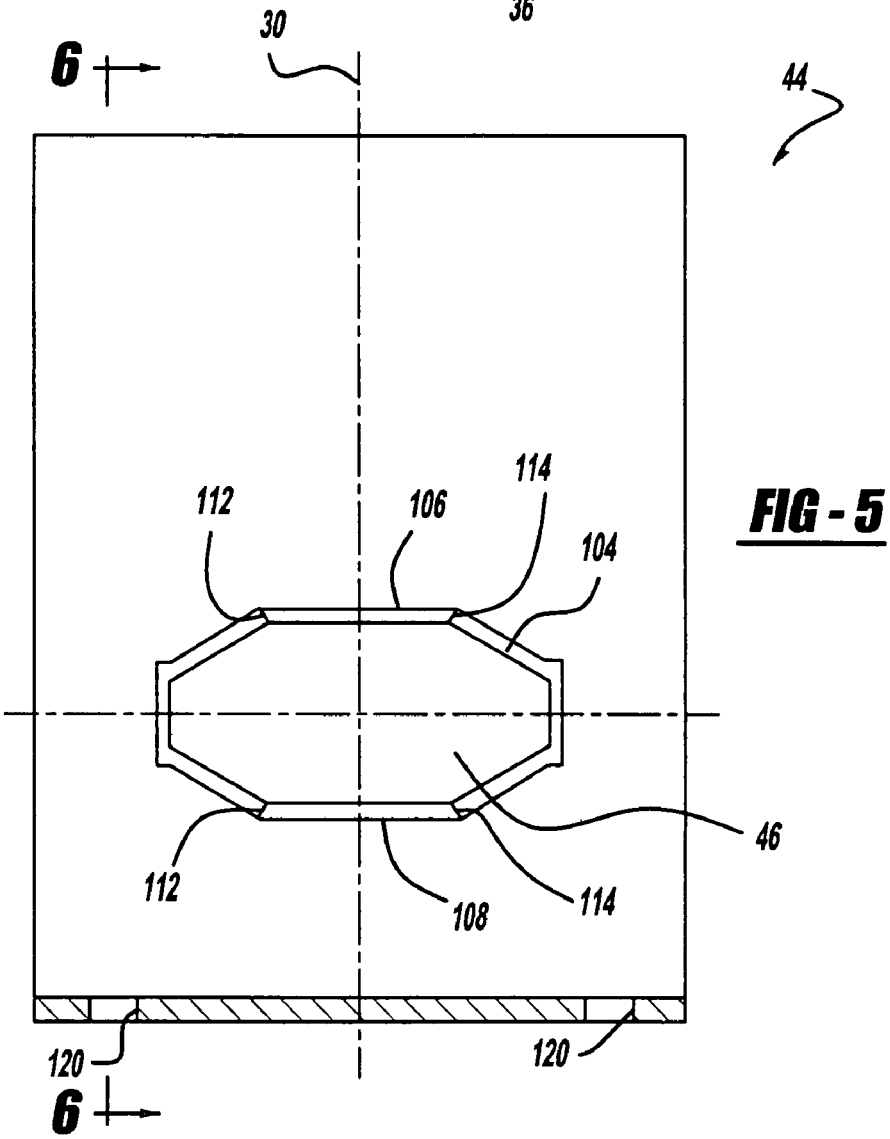
FIG. 5 is a side elevational view, shown partially in section, of the end plate associated with the adjustable bracing system shown in FIG. 1.
Figure 6:
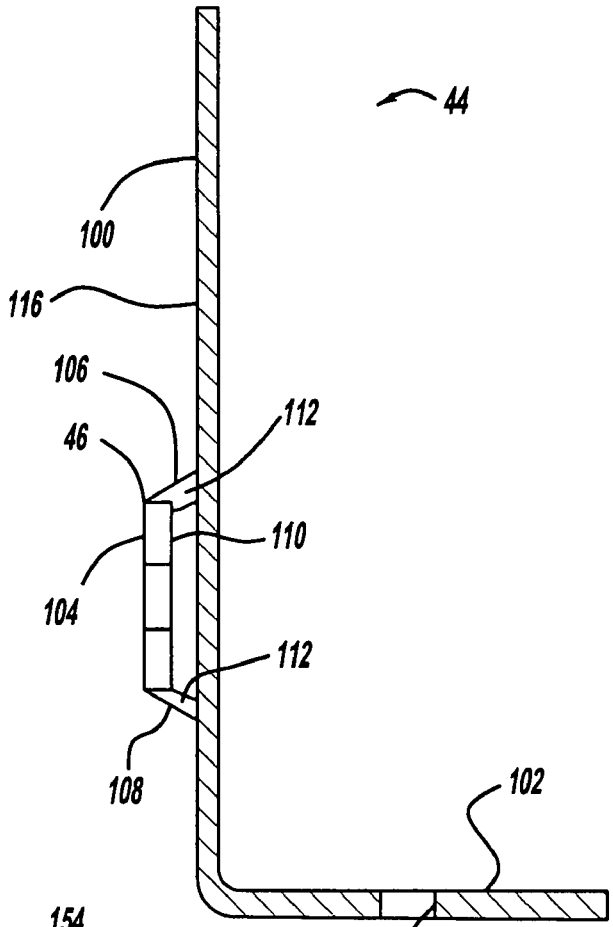
FIG. 6 is a cross-sectional view of the end plate associated with the adjustable bracing system shown in FIG. 1.
Figure 7:
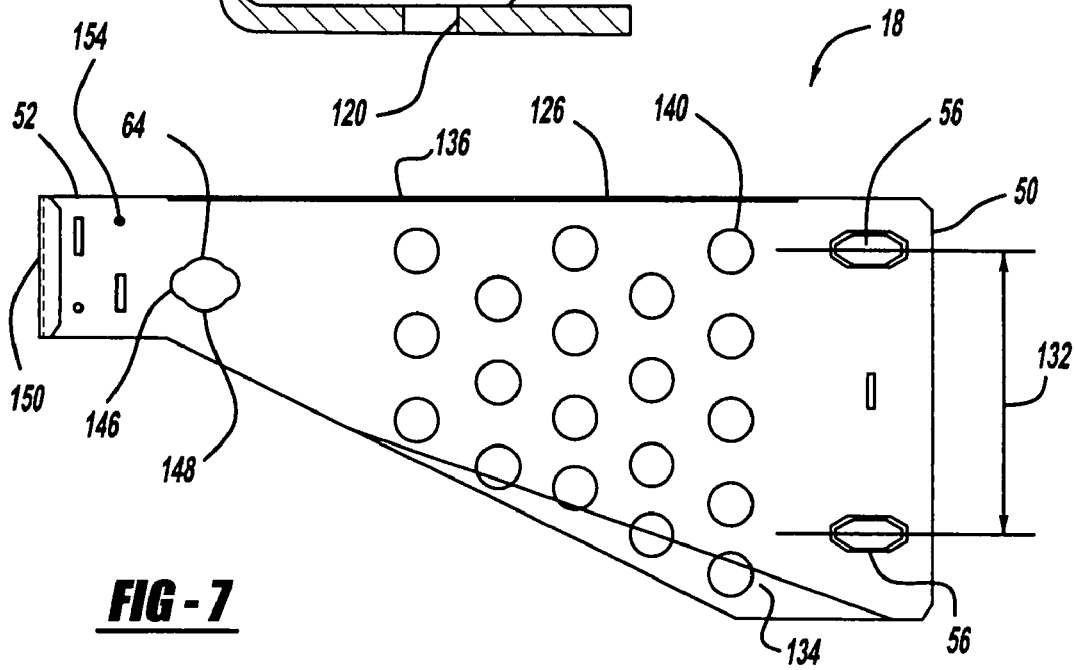
FIG. 7 is a side elevational view of the outrigger bracket associated with the adjustable bracing system shown in FIG. 1.
Figure 8:
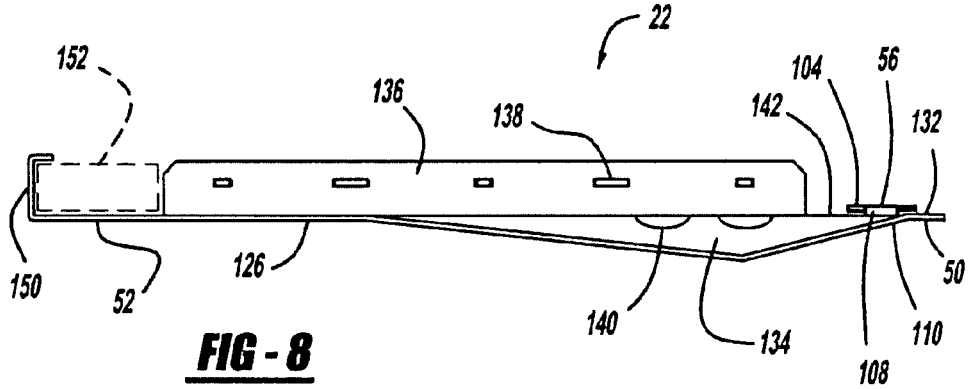
FIG. 8 is a bottom elevational view of the outrigger bracket associated with the adjustable bracing system shown in FIG. 1.

Referring to FIGS. 5-6, end plate 44 will now be described in detail. End plate 44 is removably secured to vertical member 16 and is configured to allow first end 22 of vertical member 16 to be fastened to foundation base 48. End plate 44 can be generally L-shaped as best seen in FIG. 6. End plate 44 is preferably formed from stamping a metal, such as stamped 11-gage galvanized steel. End plate 44 includes cleat 46 as previously mentioned, first leg 100 and second leg 102. Cleat 46 protrudes from first leg 100 and is configured to be received by and slidably engage one of keyed openings 40 on the lower end of vertical member 16. Cleat 46 can be formed integral to end plate 44 as shown. Cleat 46 includes a head portion 104 and shoulder portions 106, 108. Head portion 104 is configured to be received through upper portion 90 of keyed openings 40. Head portion 104 includes an inner face 110 that slidably engages first face 82 of vertical member 16 when cleat 46 is positioned within a corresponding lower portion 92 of keyed openings 40. Head portion 104 can have a polygonal shape as shown. Shoulder portions 106, 108 protrude from first leg 100 and connect head portion 104 to first leg 100. Shoulder portions 106, 108 are received within lower portion 92 of keyed openings 40 and include abutment walls 112, 114 that snugly engage bearing walls 94, 96, respectively, when cleat 46 is positioned within lower portion 92. In this manner, cleat 46 works together with one of keyed openings 40 to removably secure end plate 44 to vertical member 16.

First leg 100 is generally planar in shape and adjoins second leg 102. First leg 100 extends from second leg 102 in a substantially vertical direction. First leg 100 includes an inner face 116 that slidably engages first face 82 to ensure a snug engagement between vertical member 16 and end plate 44. Second leg 102 is generally planar and extends from first leg 100 in a substantially horizontal direction. Second leg 102 is configured to be attached to foundation base 48 using one or more fasteners (not shown). To this end, second leg 102 can include a plurality of fastener holes 120 as shown. End plate 44 can be fastened directly to foundation base 48 or to a wooden blocker 122 glued to foundation base 48 as illustrated in FIG. 1. The latter approach may be desired to avoid drilling holes in foundation base 48 to secure end plate 44 to foundation base 48.

Outrigger bracket 18 is configured to provide lateral support for frame assembly 14 and resist loads during the concrete pouring process that may associated with forming wall structure 12. Accordingly, outrigger bracket 18 is removably secured to vertical member 16 on one end and connected to strut 20 on an opposite end. In certain preferred embodiments, outrigger bracket 18 is formed of stamped 11-gage galvanized steel sheet metal. Outrigger bracket 18 includes cleats 56 disposed on first lateral end 50 as previously mentioned, a body 126, and second lateral end 52. Cleats 56 are substantially similar to cleat 46 and can be formed integral to outrigger bracket 18 on first lateral end 50 as illustrated. Cleats 56 are spaced apart by an interval 132 corresponding to the spacing of keyed openings 40 at interval 86. Additionally, cleats 56 are oriented in a manner that allows cleats 56 to be simultaneously received through a corresponding upper portion 90 of keyed openings 40 and slidably engaged with a corresponding lower portion 90 of keyed openings 40. Thus, interval 132 can be equal to interval 86 or an integer multiple of interval 86. For exemplary purposes, interval 132 is optionally about 8 inches. Thus, it will be appreciated that cleats 56 can work together with two of keyed openings 40 to removably secure outrigger bracket 18 to vertical member 16 at various points along vertical member 16.

Body 126 is generally planar in shape and configured to transmit loads between first lateral end 50 and second lateral end 52 without buckling. Body 126 can also be configured to support a working platform as may be desired. Accordingly, body 126 can include a stiffening flange 134 and a support flange 136. Stiffening flange 134 can be generally planar in shape and formed integral to body 126 between first and second lateral ends 50, 52 on the lower portion of body 126. Specifically, stiffening flange 134 can define a plane that is oblique to the major plane defined by body 126. Support flange 136 can be generally planar in shape and formed integral to body 126 between first and second lateral ends 50, 52 on the upper portion of body 126. Support flange 136 can define a plane that is substantially orthogonal with the major plane defined by body 126 and include a plurality of slots 138 extending through support flange 136. Slots 138 can be of varying lengths and spaced apart along support flange 136 as shown. To reduce the mass of outrigger bracket 18, body 126 can further include perforations 140.

First lateral end 50 is configured to work together with cleats 56 to receive and transmit loads to body 126. First lateral end 50 includes a wall 142 that can engage second face 84 of vertical member 16 when cleats 56 are positioned within a corresponding lower portion 92 of keyed openings 40. Thus, it will be appreciated that first lateral end 50 works together with cleats 56 to provide a snug engagement between outrigger bracket 18 and vertical member 16.

Second lateral end 52 includes keyed second opening 64. Second opening 144 includes a first portion 146 configured to receive engagement member 62 of strut 20 and a second portion 148 to rotatably support a portion of engagement member 62 of strut 20. First portion 146 can be generally elliptical in shape and be oriented such that the major axis of first portion 146 is substantially perpendicular to longitudinal axis 17 as illustrated. Second portion 148 can be generally circular in shape and have a diameter smaller than the major diameter of first portion 146 and corresponding to a portion of engagement member 62. Second lateral end 52 can further include a flange 150 for securing a vertical post 152, to outrigger bracket 18 in a substantially vertical orientation as may be desired. Flange 150 can be generally c-shaped and include a plurality of holes 154 that can be used to fasten post 152 to outrigger bracket 18. Post 152 can be a conventional wooden 2×4 stud or any other suitable metal or composite vertical member.

Figure 10:
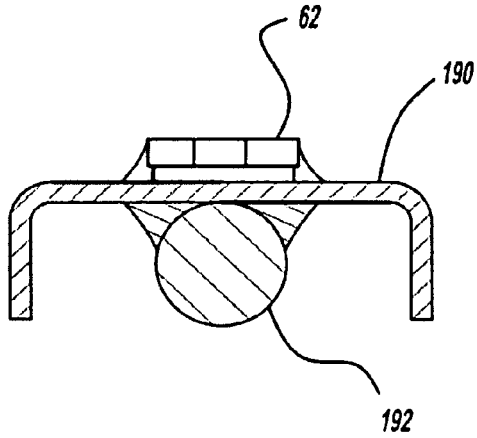
FIG. 10 is a cross-sectional view of a portion of the strut associated with the adjustable bracing system shown in FIG. 9.
Figure 9:
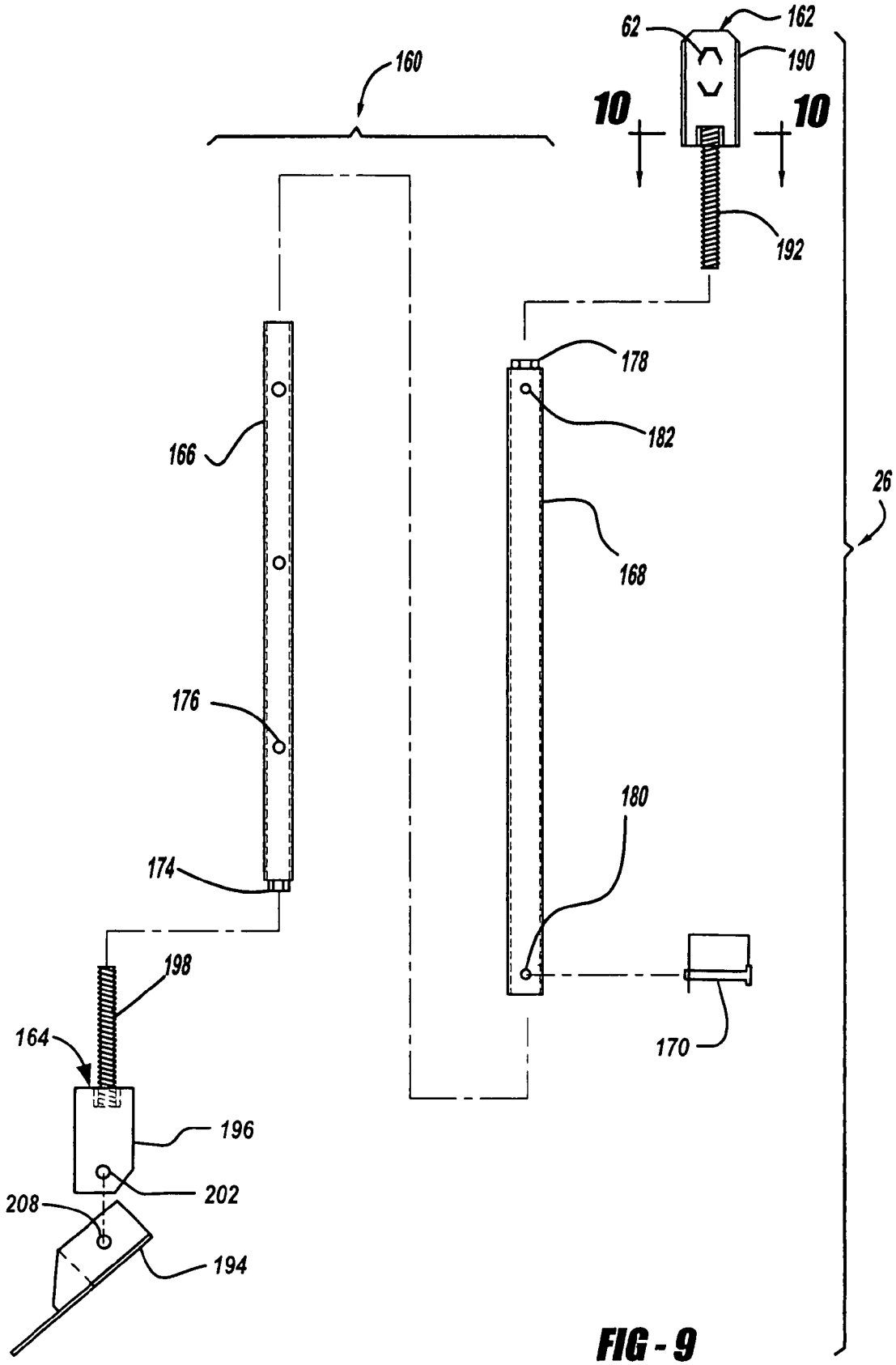
FIG. 9 is an exploded elevational view of the strut associated with the adjustable bracing system shown in FIG. 1.

Referring to FIGS. 9-10, strut 20 will now be described in detail. Strut 20 is configured to provide support for frame assembly 14 and outrigger bracket 18 and resist loads during the concrete pouring process that may be associated with forming wall structure 12. Strut 20 includes a body 160, a swivel lock assembly 162 threadingly engaged on proximal end 60 with body 160, and a pivot foot assembly 164 threadingly engaged on distal end 58 with body 160.

Body 160 includes a first tube 166, a second tube 168, and an adjustment pin 170. First tube 166 is slidably received within second tube 168 and includes a threaded portion 174 on a distal end of first tube 166 and a plurality of adjustment holes 176 extending crosswise through first tube 166. First tube 166 can be made from metal tubing, for example, in certain preferred embodiments; first tube 166 is formed of 1¼ inch square steel tubing. Threaded portion 174 is configured to threadingly engage a portion of pivot foot assembly 164 and can be a right-handed threaded steel nut welded to the end of first tube 166 as shown. Adjustment holes 176 are configured to slidably receive adjustment pin 170. Second tube 168 includes a threaded portion 178 on a distal end of second tube 168 and at least one adjustment hole 180 extending crosswise through second tube 168 in a manner similar to adjustment holes 176. It will be appreciated that adjustment hole 180 can be aligned with adjustment holes 176 by adjusting the position of first tube 166 within second tube 168. Second tube 168 can be made from smaller diameter metal tubing than first tube 166, for example in preferred embodiments second tube 168 is made of 1½ inch square steel tubing. Threaded portion 178 is configured to threadingly engage a portion of swivel lock assembly 162 and can be a left-handed threaded steel nut welded to the end of second tube 168 as shown. Adjustment pin 170 is configured to slidably engage one of the plurality of adjustment holes 176 in first tube 166 and adjustment hole 180 in second tube 168 to fix the length of body 160 as may be desired. Second tube 168 can further include an extension hole 182 extending crosswise through second tube 168 on the end having threaded portion 178 to permit an extension to be coupled to second tube 168 as will be described.

Swivel lock assembly 162 is configured to be removably secured to outrigger bracket 18. Swivel lock assembly 162 has a turn-buckle type design that includes engagement member 62, a body 190, and threaded rod 192. Engagement member 62 is substantially similar to cleat 46 as previously described and can be formed integral to body 190 on one end as shown. Body 190 is configured to receive and transmit loads between outrigger bracket 18 and strut 20. Body 190 can be generally c-shaped as shown. In certain preferred embodiments, body 190 is formed of stamped 11-gage galvanized steel. Threaded rod 192 is configured to threadingly engage threaded portion 178 of second tube 168. In certain embodiments, threaded rod 192 can be formed of left-handed ¾ coil thread steel rod and welded to body 190 as shown.

Figure 17:
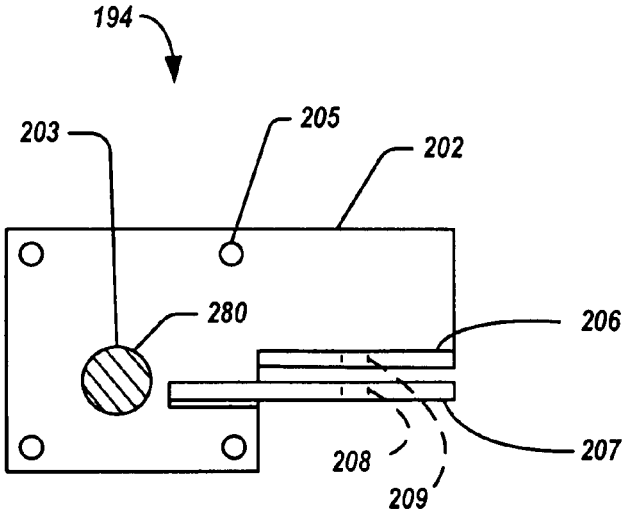
FIG. 17 is a top elevational view of a portion of the strut associated with the adjustable bracing system shown in FIG. 9.

Pivot foot assembly 164 is configured to pivotally secure strut 20 to foundation base 48. Accordingly, pivot foot assembly 164 can include a foot bracket 194, a pivot block 196, and a threaded rod 198. Foot bracket 194 and pivot block 196 can be generally formed of a wrought or stamped metal, such as galvanized stainless steel or aluminum. In one preferred embodiment, foot bracket 194 and pivot block 196 can be formed of 8-gage galvanized steel sheet metal. Foot bracket 194 is pivotally coupled to pivot block 196 and can be secured directly to foundation base 48 by a ⅞ inch perforated curb pin commonly used in the industry or to a wooden blocker 200 glued to the foundation base 48 as illustrated in FIG. 1. With particular reference to FIG. 17, foot bracket 194 can include a body 202 having a hole 203, a stanchion 204, and fastener holes 205. Body 202 is generally planar and adapted to be secured to foundation base 48 by driving a ⅞ inch perforated curb pin through hole 203. Hole 203 is adapted to snugly engage the body of the perforated curb pin and thereby inhibit relative lateral movement between body 202 and the perforated curb pin. Thus, in one preferred embodiment, hole 203 can have a diameter of about 29/32 of an inch. Alternatively, the diameter of hole 203 can vary to accommodate perforated curb pins of varying diameters. It will be appreciated that a nail, such as a 16D common nail, can be inserted through a cross-wise hole in the perforated curb pin before driving the curb pin through hole 203 and used to secure body 202 to foundation base 48 in a vertical orientation. Specifically, the curb pin can be driven through hole 203 into foundation base 48 until the nail contacts body 202.

Stanchion 204 is configured to pivotally secure body 202 to pivot block 196. Stanchion 204 can include a first support flange 206 and a second support flange 207. First and second support flanges 206, 207 are generally planar in shape and can be spaced apart to allow pivot block 196 to be slidingly received between support flanges 206, 207. First support flange 206 can be formed integral to body 202 as shown. Second support flange can be welded to body 202 as shown. First and second support flanges 206, 207 are generally oriented orthogonally to the major plane defined by body 202. First and second support flanges can include through bores 208, 209 adapted to receive a fastener (not shown) that can be used to pivotally secure stanchion 204 to pivot block 196. Fastener holes 205 can extend through body 202 to allow body 202 to be fastened to foundation base 48 or wooden blocker 200 as illustrated in FIG. 1.

Pivot block 196 is rotatably coupled to stanchion 204 of foot bracket 194 as previously described. Threaded rod 198 is configured to threadingly engage threaded portion 174 of first tube 166. Threaded rod 198 can be formed of right-handed ¾ coil thread steel rod and welded to pivot block 196 as shown. Alternate embodiments of pivot foot assembly 164 are also contemplated. For example, while pivot block 196 is shown to be connected to foundation base 48 by foot bracket 194, pivot block 196 can be connected to foundation base 48 using a curb pin as is commonly used in the industry.

From the foregoing, it will be appreciated that strut 20 can be removable secured to outrigger bracket 18 by orienting strut 20 in a manner that allows engagement member 62 to be received within first portion 146 and subsequently rotating strut 20 to a desired position. It will also be appreciated that coarse adjustments to the length of strut 20 can be made using adjustment holes 176, 180, while fine adjustments can be made by twisting body 160. In a weight-bearing position, strut 20 is preferably positioned at an angle between 35° and 50° from longitudinal axis 17 as shown.

Referring now to FIGS. 11-15, a second preferred embodiment of an adjustable brace assembly 210 for a vertical tall wall structure 212 according to the principles of the present disclosure will now be described. Brace assembly 210 is similar to brace assembly 10 described above, and for brevity shares like reference numerals for common elements. Brace assembly 210 is generally configured to provide lateral support for vertical wall structures that are greater than about 10 feet in height. Additionally, brace assembly 210 provides features which allow brace assembly 210 to be installed quickly to support wall structure 212 and assist in the pouring process that may be associated with forming wall structure 212. Wall structure 212 can be any vertical wall structure to which brace assembly 210 can be attached.

Brace assembly 210 includes a frame assembly 220, outrigger bracket 18, a first strut 224, an intermediate brace 226, a second strut 228, and a stiffback 230. Frame assembly 220 engages wall structure 212 and is configured to provide adjustable lateral support for wall structure 212. Accordingly, frame assembly 220 is removably secured to a foundation 232 at a lower end and includes a vertical member 234 that extends in a vertical direction along longitudinal axis 236. Foundation 232 provides ground support for wall structure 212 and can be a poured concrete slab-on-grade foundation as shown.

Figure 11:
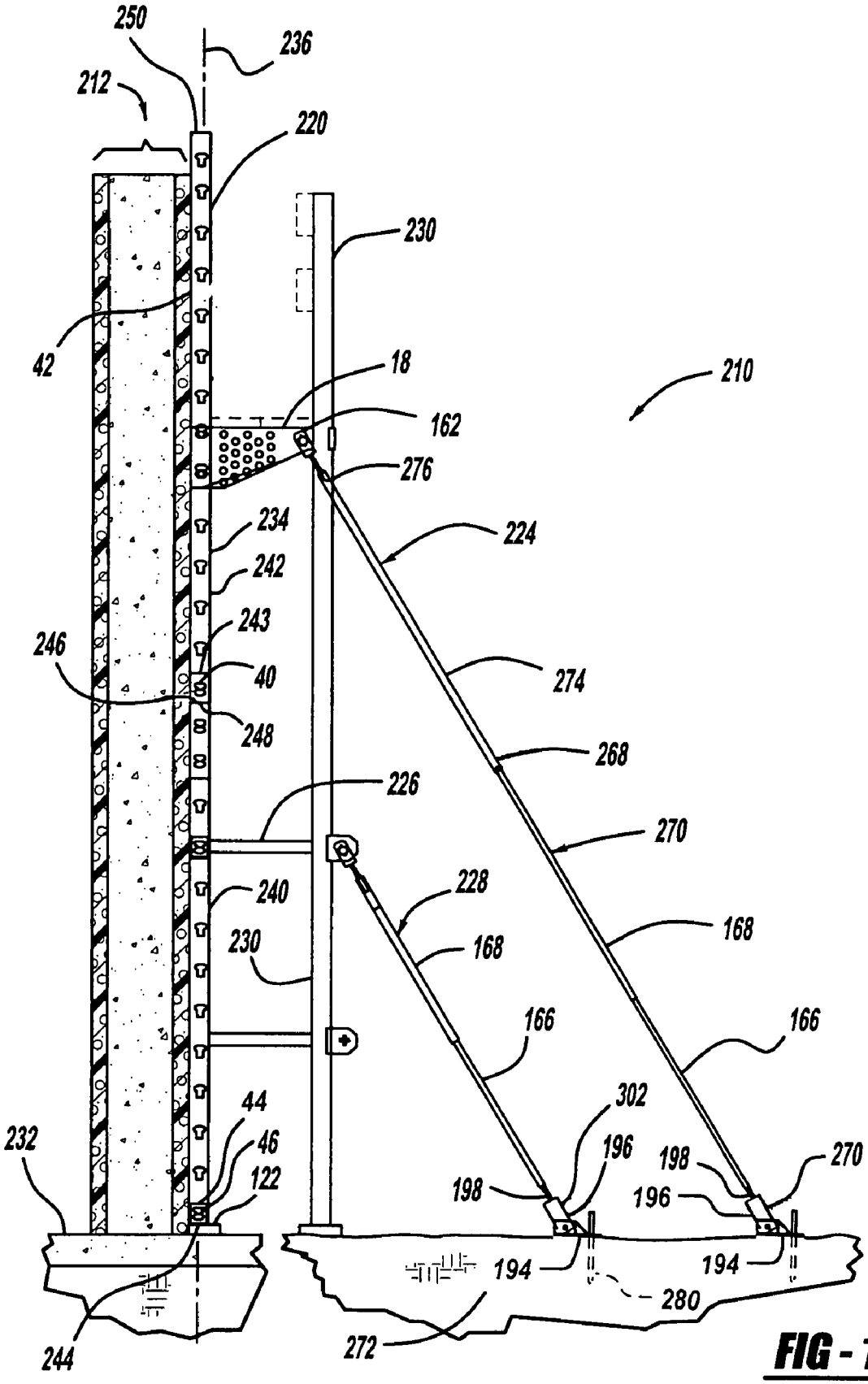
FIG. 11 is a partially fragmented side elevational view showing another adjustable bracing system for a vertical wall structure according to the principles of the present disclosure.
Figure 12:
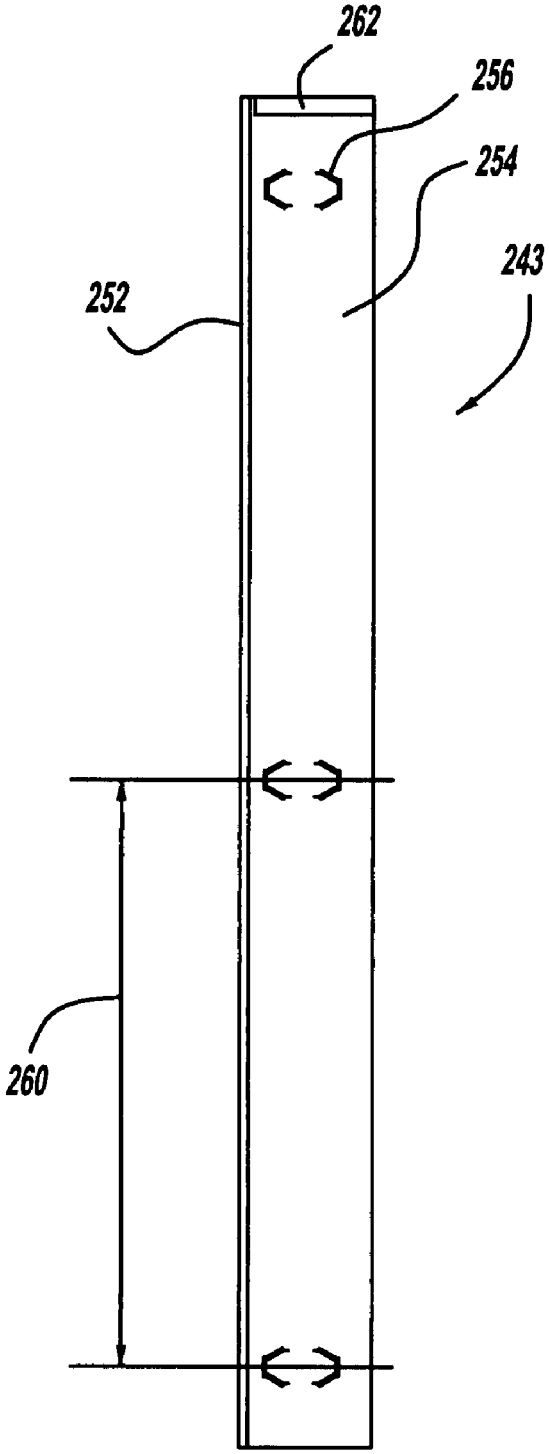
FIG. 12 is a side elevational view of the extension associated with the adjustable bracing system shown in FIG. 11.
Figure 13:
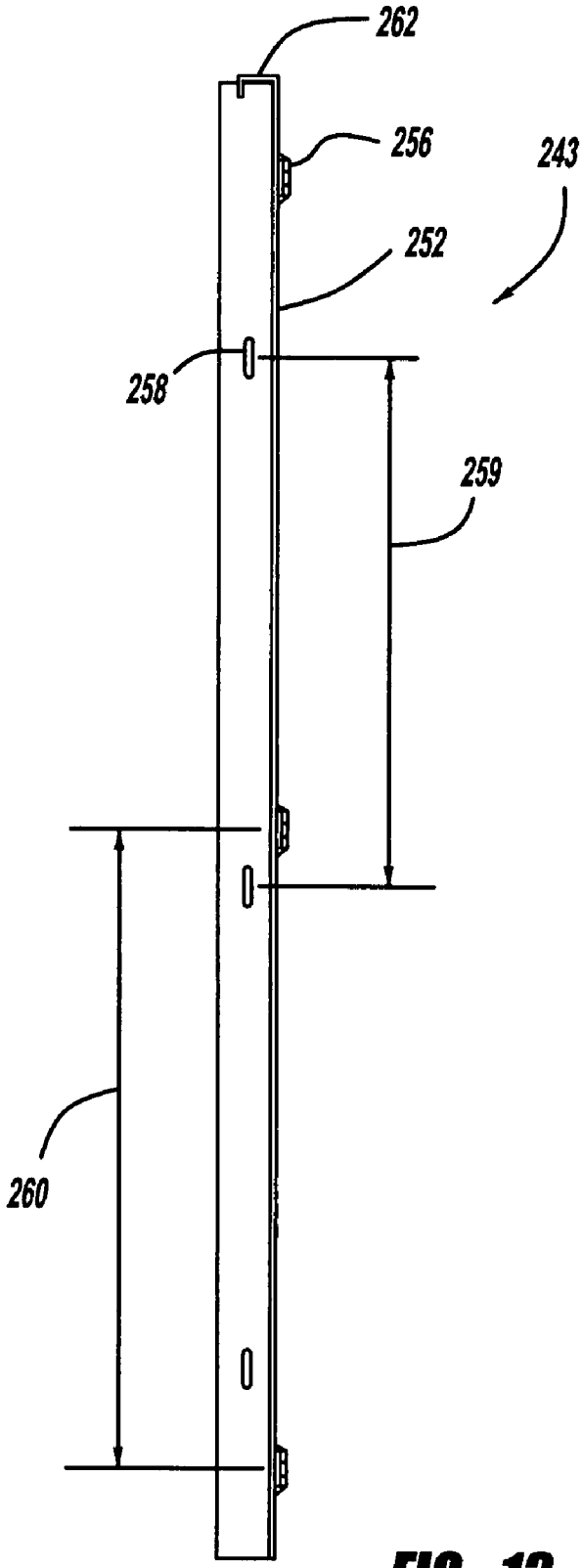
FIG. 13 is front elevational view of the extension associated with the adjustable bracing system shown in FIG. 11.
Figure 14:
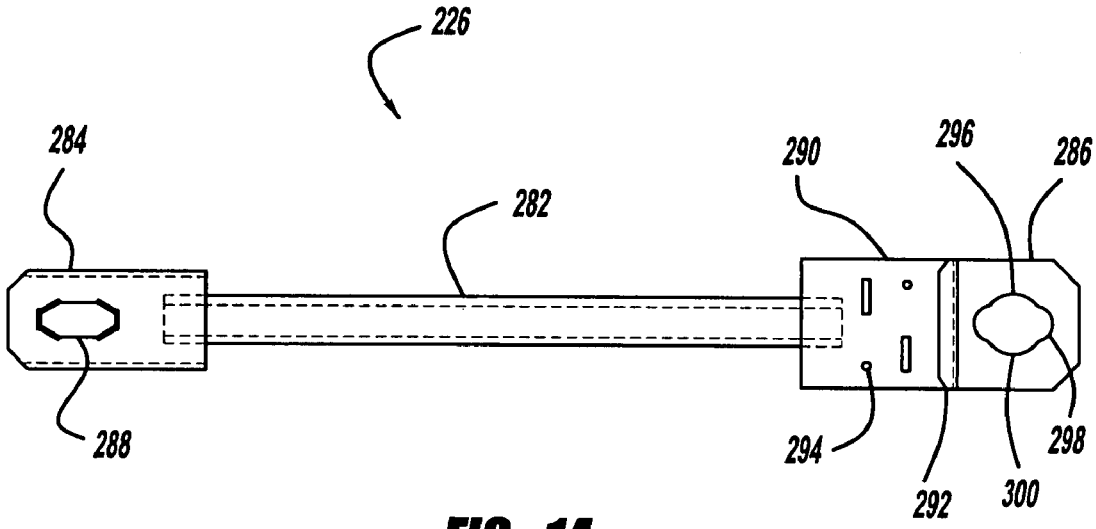
FIG. 14 is a side elevational view of the intermediate brace associated with the adjustable bracing system shown in FIG. 11.
Figure 15:
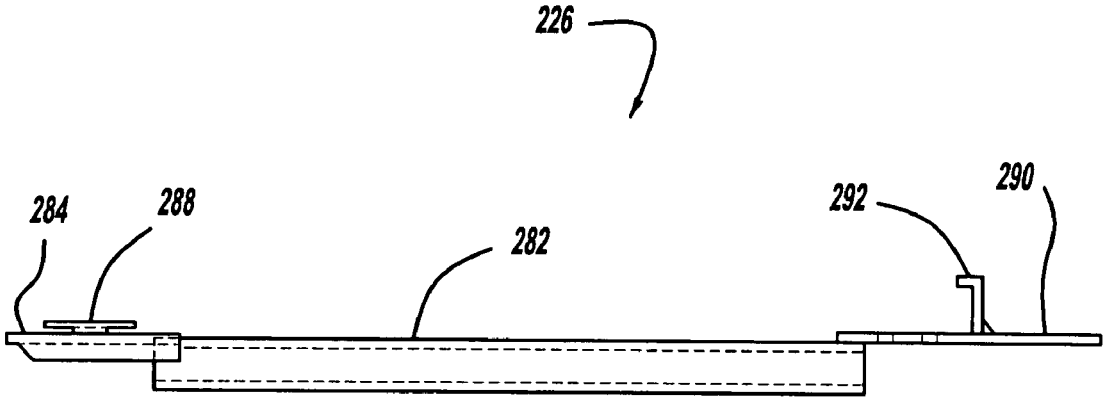
FIG. 15 is a bottom elevational view of the intermediate brace associated with the adjustable bracing system shown in FIG. 11.

Referring still to FIG. 11, vertical member 234 includes discrete components, namely a first frame member 240 and a second frame member 242 connected to first frame member 240 by an extension 243. Frame assembly 220 further includes an endplate 44. First and second discrete frame members 240, 242 are substantially similar to vertical member 16 as previously described. First frame member 240 has a first end 244 and a second end 246 and second frame member similarly has a first end 248 and a second end 250. The first and second frame members, 240, 242 are aligned along their respective longitudinal axes to form the single longitudinal axis 236. Thus, first end 244 of first frame member 240 attaches to end plate 44. Second end 246 of first frame member 240 is coupled to first end 248 of second frame member 242 via extension member 243. First and second frame members 240, 242 each include first flange portion 36, web portion 38, keyed openings 40, and second flange portion 42. Additionally, keyed openings 40 are spaced at regular interval 86. It will be appreciated that keyed openings 40 in first and second frame members 240, 242 can be located along web portion 38 such that when first frame member 240 and second frame member 242 are placed end-to-end as shown, the spacing between keyed openings 40 in first frame member 240 and keyed openings 40 in second frame member 242 remains the same. It should also be appreciated that first and second frame members 240, 242 can have varying lengths, for example, about 8 feet or 10 feet, as previously described. Alternatively, one or both of frame members 240, 242 may be cut to any other desired length to coincide with varying heights of wall structure 212.

As described above, extension 243 is configured to couple the second end 246 of first frame member 240 with the first end 248 of second frame member 242 and provides structural support between first frame member 240 and second frame member 242. Extension 243 can be generally L-shaped and formed of stamped metal. In certain preferred aspects, extension 243 is formed from 11-gage or 12-gage galvanized steel sheet metal. Extension 243 includes a flange 252 and a body 254 having a plurality of engaging members, or cleats 256. Flange 252 is generally planar in shape and adapted to slidingly engage a portion of first flange portion 36 of first and second frame members 240, 242 when extension 243 is connected to first and second frame members 240, 242. Flange 252 can include a plurality of slots 258 spaced at an interval 259 along flange 252 and located such that slots 258 align with slots 76, 78 in first and second frame members 240, 242 when extension 243 is connected to first and second frame members 240, 242. For exemplary purposes, slots 258 can be spaced at an interval 259 equal to about 6 inches.

Body 254 is generally planar in shape and adapted to slidingly engage a first face 82 of web portion 38 of first and second frame members 240, 242 when extension 243 is connected to first and second frame members 240, 242. For exemplary purposes, body 254 can have three engaging member cleats 256, as shown. Cleats 256 protrude from the side of body 254 opposite flange 252 and are substantially similar to cleats 46, 56. Cleats 256 can be formed integral to extension 243. Cleats 256 are spaced apart by an interval 260 corresponding to the spacing of keyed openings 40 at interval 86. Thus, interval 260 can be equal to interval 86 or an integer multiple of interval 86. For exemplary purposes, interval 260 is 8 inches. Additionally, cleats 256 are oriented in a manner that allows each of cleats 256 to be simultaneously received by a corresponding upper portion 90 of keyed openings 40 and slidably engaged by a corresponding lower portion 90 of keyed openings 40. Specifically, two of cleats 256 can engage a corresponding two of keyed openings 40 at the second end 246 of first frame member 240 as illustrated in FIG. 11. The third of cleats 256 can engage a corresponding one of keyed openings 40 at the first end 248 of second frame member 242. Extension 243 can further include a turndown flange 262 located on the upper end of extension 243 that facilitates the assembly of extension 243 to first and second frame members 240, 242. Specifically, turndown flange 262 provides a surface that can be used to drive extension 243 into sliding engagement with first and second frame members 240, 242. In the foregoing manner, cleats 256 can work together with keyed openings 40 of first and second frame members 240, 242 to removably secure first frame member 240 to second frame member 242.

End plate 44 is configured to secure the first end 244 of first frame member 240 to foundation 232. Accordingly, end plate 44 includes cleat 46 and is removably secured to the first end 244 of first frame member 240 in the manner previously described for vertical member 16. End plate 44 can be secured to a wooden blocker 122 glued to foundation 232.

Outrigger bracket 18 is configured to provide support for frame assembly 220 and distribute loads during the concrete pouring process that may be associated with forming wall structure 212. Accordingly, first lateral end 50 of outrigger bracket 18 can be removably secured to frame assembly 220 and second lateral end 52 of outrigger bracket 18 can be connected to first strut 224. Additionally, stiffback 230 can be received within flange 150 and secured to outrigger bracket 18 as shown.

First adjustable length strut 224 is configured to be pivotally secured to outrigger bracket 18 and intermediate brace 226 and thereby provide support for frame assembly 220 and resist loads during the concrete process that may be associated with forming wall structure 212. For exemplary purposes, first strut 224 can be removably secured to outrigger bracket 18 as illustrated in FIG. 11. It will be appreciated that first adjustable length first strut 224 is similar to adjustable length strut 20, however first strut 224 is adapted to span greater distances than strut 20. As such, first strut 224 can include a body 268, a swivel lock assembly 162 threadingly engaged with body 268 to couple one end of first strut 224 to outrigger bracket 18, and a pivot foot assembly 270 threadingly engaged with body 268 to secure an opposite end of outrigger bracket 18 to an earth foundation 272. Body 268 includes first tube 166, second tube 168, and an extension tube 274. First tube 166 retains all of the features previously described and includes threaded portion 174 for threadingly engaging a portion of pivot foot assembly 270. Similarly, second tube 168 retains the features previously described and can be secured to first tube 166 using adjustment pin 170. Extension tube 274 is configured to receive second tube 168 and includes a threaded portion 276 on a distal end of extension tube 274 and at least one adjustment hole 278. For exemplary purposes, extension tube 274 can be made from 1¾ inch square steel tubing. Threaded portion 276 is configured to threadingly engage a portion of swivel lock assembly 162 and can be a left-handed threaded steel nut welded to the end of extension tube 274 as shown. Adjustment hole 278 extends crosswise through extension tube 274 in a manner similar to extension hole 182 of second tube 168. Thus, it will be appreciated that adjustment hole 278 can be aligned with extension hole 182 by adjusting the position of second tube 168 within extension tube 274. With adjustment hole 278 aligned with extension hole 182, extension tube 274 can be secured to second tube 168 using another adjustment pin 170.

Pivot foot assembly 270 is configured to pivotally secure first strut 224 to foundation 272 using a perforated curb pin 280. While not limiting, perforated curb pin 280 can be a ⅞ inch perforated curb pin, which is commonly used in construction and includes a plurality of cross-wise holes configured to receive a 16D common nail. Pivot foot assembly 270 is substantially similar to pivot foot assembly 164. Accordingly, pivot foot assembly 270 includes foot bracket 194, pivot block 196, and threaded rod 198 as previously described. Foot bracket 194 can include hole 203 having a diameter of 29/32 inch. Threaded rod 198 can be welded to pivot block 196 on one end and threadingly engaged with first tube 166 of first strut 224. Thus, it will be appreciated that pivot foot assembly 270 can be pivotally secured to foundation 272 by inserting a nail cross-wise through perforated curb pin 280 and driving perforated curb pin 280 through hole 203 into foundation 272 until the nail contacts foot bracket 194 as illustrated in FIG. 11. It will be appreciated that a sufficient portion of perforated curb pin 280 must be driven into foundation 272 to create a stable and secure attachment of pivot foot assembly 270 to foundation 272.

Intermediate brace 226 is configured to be removably secured on one end to frame assembly 220 at any one of the plurality of keyed openings 40 and to receive stiffback 230 on an opposite end. Intermediate brace 226 can also be configured to allow first strut 224 or second strut 228 to be pivotally secured on one end. Additionally, intermediate brace 226 is configured to serve as a rung in a ladder that can be constructed using intermediate brace 226. Intermediate brace 226 includes a support 282, a first end 284, and a second end 286. Support 282 can be tubular in shape and constructed of 1.5 inch square steel tubing as shown. First end 284 is configured to be removably secured to frame assembly 220 and can be welded to one end of support 282. First end 284 is generally c-shaped and can be formed from 11-gage galvanized steel. First end 284 can be welded to one end of support 282 and includes an engaging member cleat 288. Cleat 288 protrudes from the side of first end 284 and is substantially similar to cleats 46, 56, 254 as previously described. Cleat 288 can be formed integral to first end 284. Accordingly, it will be appreciated that cleat 288 can work together with one of keyed openings 40 associated with first and second frame members 240, 242 to removably secure first end 284 to one of first and second frame members 240, 242.

Second end 286 is generally planar in shape and can be formed of 11-gage galvanized steel. Second end 286 includes a body 290, a flange 292, and a plurality of holes 294. Body 290 is generally planar in shape and can be welded to support 282. Flange 292 is generally L-shaped and configured to receive a portion of stiffback 230. Flange 292 can be welded to second end 286. Holes 294 extend through body 290 proximate flange 292 to allow fasteners (not shown) to be used to fasten stiffback 230 to second end 286.

As previously mentioned herein, intermediate brace 226 can also be configured to allow first strut 224 or second strut 228 to be pivotally secured on one end. To this end, body 290 can extend beyond flange 292 and further include keyed opening 296 as shown. Keyed opening 296 extends through body 290 and includes a first portion 298 configured to receive engagement member 62 of first strut 224 and a second portion 300 to rotatably support a portion of engagement member 62. First and second portions 298, 300 are substantially similar to first and second portions 146, 148, respectively. Thus, it will be appreciated that second end 286 can work together with swivel lock assembly 162 to pivotally secure first strut 224 to intermediate brace 226.

Second strut 228 is configured to be secured to outrigger bracket 18 and intermediate brace 226 and to provide support for frame assembly 220 and resist loads during the concrete process that may be associated with forming wall structure 212. Second strut 228 is optionally removably secured to intermediate brace 226 as shown to provide additional support for wall structure 212 at a point between foundation 232 and outrigger bracket 18, where necessary. For example, as the wall height becomes relatively high, it may be desirable to include the second strut 228 (or a plurality of additional struts) for additional load distribution and vertical support below the first strut 224. Second strut 228 is substantially similar to strut 20 and includes swivel lock assembly 162, first tube 166, second tube 168, adjustment pin 170, and a pivot foot assembly 302. Pivot foot assembly 302 is configured to pivotally secure second strut 228 to foundation 272 using a perforated curb pin 280 as previously described herein for pivot foot assembly 270. Accordingly, pivot foot assembly 302 includes foot bracket 194, pivot block 196, and threaded rod 198. Foot bracket 194 can include hole 203 having a diameter of 29/32 inch. Threaded rod 198 can be welded to pivot block 196 on one end and threadingly engaged with first tube 166 of first strut 224. Thus, it will be appreciated that pivot foot assembly 302 can be pivotally secured to foundation 272 in substantially the same manner as pivot foot assembly 270 as illustrated.

Stiffback 230 provides additional support for frame assembly 220, outrigger bracket 18, and intermediate brace 226. Stiffback 230 can be a standard vertical post, such as a wooden 2×4 stud that extends from foundation 272 to a point beyond the location of outrigger bracket 18 as may be desired. Stiffback 230 can be positioned and secured to outrigger bracket 18 and intermediate brace 226 using a plurality of fasteners as previously described. In the foregoing manner, stiffback 230 can provide additional vertical support for outrigger bracket 18 and intermediate brace 226 and additional lateral support for frame assembly 220.

Figure 16:
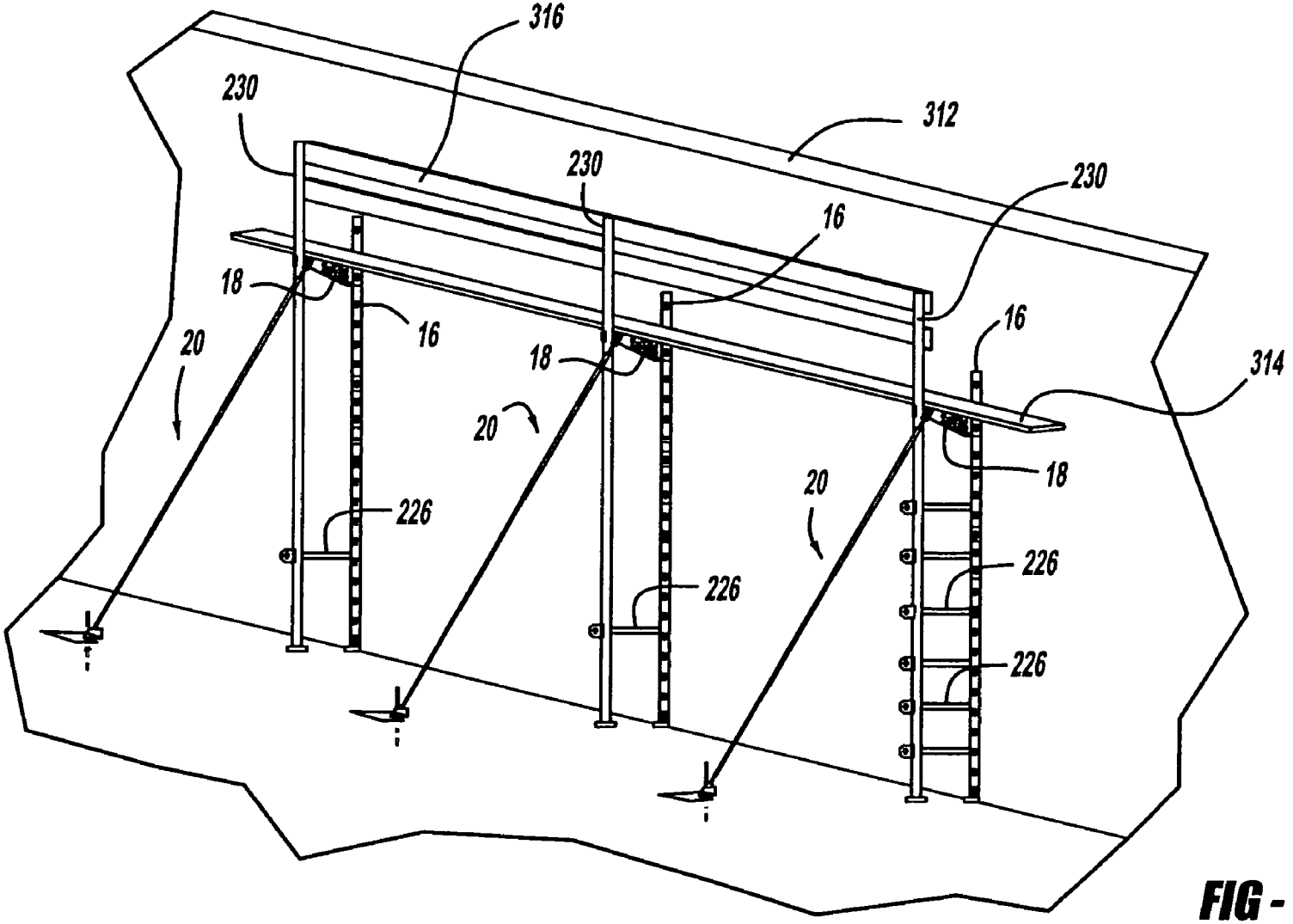
FIG. 16 is a perspective view showing yet another adjustable bracing system for a vertical wall structure according to the principles of the present disclosure.

Referring now to FIG. 16, a brace assembly 310 of a third preferred embodiment, illustrating certain principles of the present invention, will now be described in detail. Brace assembly 310 illustrates one of a variety of ways the various components of brace assembly 10 and brace assembly 210 can be combined to provide integrated support for a vertical wall structure 312. Brace assembly 310 also illustrates how the various components of brace assembly 10 and brace assembly 210 can be combined to provide a structural working platform and related ladder assembly.

Accordingly, brace assembly 310 can include a plurality of the following components: vertical member 16, outrigger bracket 18, strut 20, stiffback 230, and intermediate brace 226. Brace assembly 310 can further include a walk plank 314 and safety rails 316. Brace assembly 310 can be secured to wall structure 312 at regular intervals, for example, every 4 feet, to provide lateral support at specific points along the length of wall structure 312. Additionally, each outrigger bracket 18 of brace assembly 310 can be secured to a corresponding vertical member 16 at a position about 40 inches below the top of wall structure 312 to provide a suitable working platform height as will be described. Stiffback 230 can be secured to every other vertical member 16 and extend about 42 inches above walk plank 314. Intermediate brace 226 can be secured at regular intervals, for example, about every 12 inches, along a corresponding vertical member 16 and stiffback 230 as shown to form a ladder assembly. Walk plank 314 can be placed on outrigger bracket 18 to form the basis of a working platform. Walk plank 314 can be loosely fastened to each corresponding outrigger bracket 18 using elongated slots 138 to allow each brace assembly 10 to be individually adjusted to set the desired position of wall structure 312. Additionally, once the position of wall structure 312 is set, walk plank 314 can be tightly fastened to each outrigger bracket 18. As such it will be appreciated that walk plank 314 can be used as a whaler for providing longitudinal support for maintaining wall structure 312 straight along its length. Safety rails 316 can be fastened to stiffback 230 at desired heights above outrigger bracket 18 to provide adequate guarding for a working platform.

From the foregoing discussion, it should be apparent that brace assemblies 10, 210, 310 can be used to reduce the setup time required to provide lateral support for a vertical wall structure. The brace assemblies according to the present disclosure provide the ability to easily adjust the vertical brace assembly height, even after assembling and securing the brace assembly in a weight-bearing position. Furthermore, the design of the present brace assemblies provides the ability to adjust the amount of vertical support for both fine and/or course tuning to ensure appropriate shoring of the vertical wall prior to setting. Additionally, brace assemblies according to the principles of the present disclosure can be disassembled, reused, and transported in a convenient manner. Thus, the principles of the present disclosure provide a robust and light-weight brace assembly, which can be easily transported, occupying less volume than previous systems. Moreover, the bracing assemblies of the present disclosure provide the ability to support tall wall height structures, via the extension member design. Finally, bracing assemblies according to the present disclosure provide a means for integrating a working platform and associated ladder that also serve as additional support for a vertical wall structure.

While the principles of the present disclosure are described in connection with specific wall structures and brace assemblies, it will be appreciated by one skilled in the art that the broad teachings of the present disclosure can be implemented in a variety of forms to provide an adjustable bracing system for a variety of wall structures. Therefore, while this disclosure has been described in connection with a particular example thereof, the true scope of the present disclosure should not be so limited, because it is contemplated that other modifications within the scope of the invention will become apparent to the skilled practitioner upon a study of the drawings, the specification, and the following claims. For example, the invention should not be limited to the representative and exemplary dimensions set forth above. It is intended by the following claims to cover these and any other departures from the disclosed embodiments which fall within the true spirit of this invention.

What is claimed is:

1. A bracing system for supporting a vertical wall structure comprising:

a vertical member comprising at least two keyed openings, said vertical member having a substantially Z-shaped cross-section, the Z-shaped cross-section including a first flange portion separated from a second flange portion by a web portion, the first flange portion contacting the vertical wall structure;

a bracket comprising at least two cleat members being removably engagable with said at least two keyed openings of said vertical member said bracket including a first end including said cleats and a second end; and an adjustable strut member having an end secured to said second end of said bracket, wherein said at least two keyed openings of said vertical member have a key-shape defining a major axis parallel to said longitudinal axis of said vertical member, said keyed openings respectively comprising an upper section for receiving one of said cleat members and a lower section for slidably engaging said respective cleat member via an interference fit wherein the vertical member and bracket are reversibly joined without the use of a separate fastener wherein the bracket and vertical brace remain joined under a load.

2. The bracing system of claim 1, wherein said vertical member further comprises a first end and a second end defining therebetween a longitudinal axis and said at least two keyed openings are disposed along said longitudinal axis.

3. The bracing system of claim 1, wherein said Z-shaped cross section defines a plurality of bends, said plurality of bends including a first bend having a first angle and a second bend having a second angle, wherein said first angle and said second angle are about 90°.

4. The bracing system of claim 1 wherein the vertical wall structure comprises insulated concrete forms including at least one anchoring region and at least one fastening member for coupling said vertical member to said anchoring region.

5. The bracing system of claim 1 wherein said adjustable strut comprises a swivel lock assembly in a region near said proximal end.

6. The bracing system of claim 1 further comprising a foundation and an end plate for pivotally securing said second end of said first vertical member to said foundation, wherein said endplate includes an engagement member that can be removably secured within one of said plurality of first keyed openings to couple said first longitudinal member and said end plate.

7. A brace assembly for a vertical tall wall structure comprising:

a vertical member having a substantially Z-shaped cross-section, the Z-shaped cross-section including a first flange portion separated from a second flange portion by a web portion, the first flange portion contacting the vertical wall structure, said vertical member defining a longitudinal axis having a plurality of keyed openings formed therein, said vertical member comprising a plurality of discrete vertical sections and an extension member securing said discrete vertical sections, wherein said extension member comprises a plurality of cleat members, wherein at least one of said plurality of cleat members is secured within a corresponding one of said plurality of keyed openings associated with each of said discrete vertical sections;

a bracket having a first lateral end and a second lateral end, wherein said first lateral end is secured to said vertical member via at least two of said plurality of keyed openings and said second lateral end includes at least one second opening; and an adjustable length strut member having a distal end and a proximal end, wherein said proximal end is secured to said second lateral end of said bracket member via said second opening and said distal end is pivotally coupled to a support substantially orthogonal to said longitudinal axis, wherein said at least two keyed openings of said vertical member have a key-shape defining a major axis parallel to said longitudinal axis of said vertical member, said keyed openings respectively comprising an upper section for receiving one of said cleat members and a lower section for slidably engaging said respective cleat member via an interference fit wherein the vertical member and bracket are reversibly joined without the use of a separate fastener wherein the bracket and vertical brace remain joined under a load.

8. The brace assembly of claim 7 wherein said bracket further comprises a flange along said second lateral end for attachment to a vertical post.

9. The brace assembly of claim 8, further comprising an intermediate brace having a cleat for engagement with at least one of said plurality of keyed openings of said vertical member and a receiving structure on a second end for attaching to said vertical post to form a horizontal support member.

10. The brace assembly of claim 9 further comprising a plurality of said horizontal support members to form a ladder structure.

11. The brace assembly of claim 7 wherein the brace assembly further comprises a second adjustable length strut member attached to said vertical member at a different height via an intermediate brace having a cleat at a terminal end and a pivotal attachment point for said second adjustable length strut member.

12. A method of assembling a bracing structure for a building wall structure, the method comprising:

attaching a vertical member to said building wall structure, wherein said vertical member has a substantially z-shaped cross-section including a first flange portion separated from a second flange portion by a web portion, the first flange portion contacting the vertical wall structure and said vertical member includes at least two keyed openings;

reversibly securing a bracket to said vertical member via said at least two keyed openings said bracket including a first end including cleat members and a second end; and attaching an adjustable strut member to said bracket at said second end, wherein said at least two keyed openings of said vertical member have a key-shape defining a major axis parallel to said longitudinal axis of said vertical member, said keyed openings respectively comprising an upper section for receiving one of said cleat members and a lower section for slidably engaging said respective cleat member via an interference fit wherein the vertical member and bracket are reversibly joined without the use of a separate fastener wherein the bracket and vertical brace remain joined under a load.

13. The method of claim 12, wherein said vertical member further comprises a first longitudinal member, a second longitudinal member, and an extension member, each of said first and second longitudinal members including a plurality of said keyed openings, said extension member including a plurality of engagement members, the method further comprising:

engaging at least one of said plurality of engagement members with said keyed openings in said first longitudinal member; and engaging at least one other of said plurality of engagement members with said keyed openings in said second longitudinal member.

14. The method of claim 13 wherein said engagement members are cleats.

* * * * *